US007810288B2

(12) United States Patent
Lechasseur

(10) Patent No.: US 7,810,288 B2
(45) Date of Patent: Oct. 12, 2010

(54) CLADDING METHOD AND SYSTEM FOR BUILDINGS

(76) Inventor: André Lechasseur, 8545, Bonnivet, Saint-Léonard, Quebec (CA) H1P 2H5

( * ) Notice: Subject to any disclaimer, the term of this patent is extended or adjusted under 35 U.S.C. 154(b) by 487 days.

(21) Appl. No.: 11/730,934

(22) Filed: Apr. 5, 2007

(65) Prior Publication Data

US 2007/0245652 A1 Oct. 25, 2007

(30) Foreign Application Priority Data

Apr. 5, 2006 (GB) ..... 0606824.1

(51) Int. Cl.
*E04B 2/96* (2006.01)

(52) U.S. Cl. ..... 52/235; 52/506.06; 52/508; 52/509; 52/395; 52/396.1; 52/468

(58) Field of Classification Search ..... 52/235, 52/508, 509, 511, 512, 764, 747.1, 506.05, 52/506.06, 506.08, 573.1, 395, 396.04, 396.1, 52/403.1, 468

See application file for complete search history.

(56) References Cited

U.S. PATENT DOCUMENTS 2,115,238 A * 4/1938 Stevens ..... 52/402
2,990,650 A * 7/1961 Attwood ..... 52/468
3,410,043 A * 11/1968 Rijnders ..... 52/506.08
3,846,951 A * 11/1974 Paull ..... 52/745.09
4,783,941 A * 11/1988 Loper et al. ..... 52/235
5,263,292 A * 11/1993 Holland et al. ..... 52/235
5,522,193 A * 6/1996 Sommerstein et al. ..... 52/235
5,709,056 A * 1/1998 Matsuyama et al. ..... 52/235
6,138,419 A * 10/2000 Sekiguchi et al. ..... 52/235
7,191,570 B1 * 3/2007 Eaton ..... 52/506.09
2004/0134143 A1 * 7/2004 Boyer ..... 52/235
2005/0060950 A1 * 3/2005 Hauschildt et al. ..... 52/235

* cited by examiner

*Primary Examiner*—Robert J Canfield
*Assistant Examiner*—Jessie Fonseca

(57) ABSTRACT

A cladding system for cladding a supporting structure, the cladding system includes two cladding panels each defining a respective substantially laterally extending panel flange. The cladding panels are attachable to the supporting structure in a substantially coplanar and side-by-side relationship relatively to each other. The system also includes a cladding moulding insertable between the first and second cladding panel, the cladding moulding defining a moulding base and two moulding legs each extending from the moulding base substantially opposed to each other, the two moulding legs being angled relatively to the moulding base, each of the moulding legs defining a respective leg edge substantially opposed to the moulding base. The cladding moulding being substantially resiliently deformable between an undeformed configuration and a deformed configuration, the moulding legs being spaced apart from each other by a smaller distance in the deformed configuration than in the undeformed configuration. The substantially resilient deformation of the cladding moulding allows for snapping the cladding moulding in place between the first and second cladding panels after the first and second cladding panels have been attached to the supporting structure and the removal the cladding moulding from the supporting structure while leaving the cladding panels in place by deforming the cladding moulding into the deformed configuration and sliding the cladding moulding through the gap formed between adjacent panel flanges.

10 Claims, 6 Drawing Sheets

Fig. 7
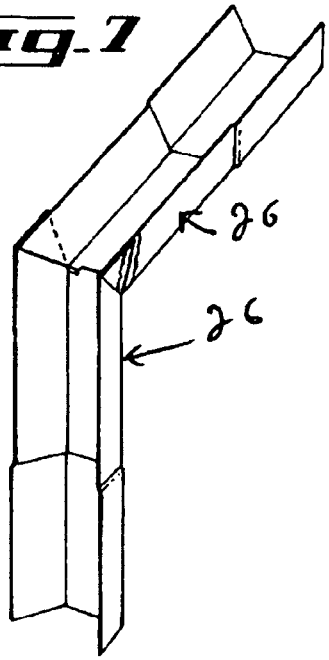
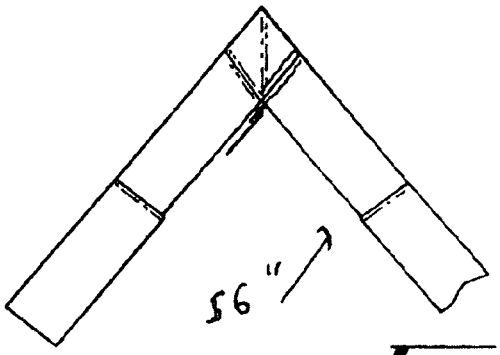
Fig. 8
Fig. 9
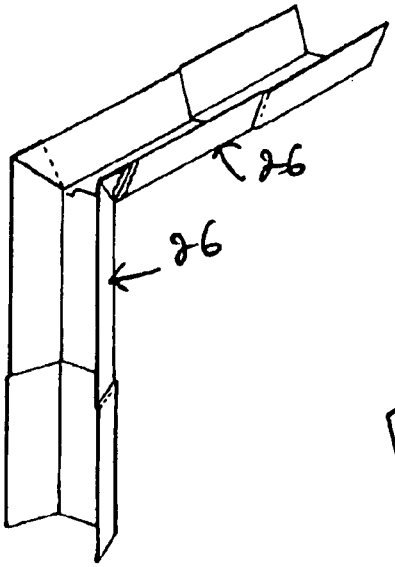
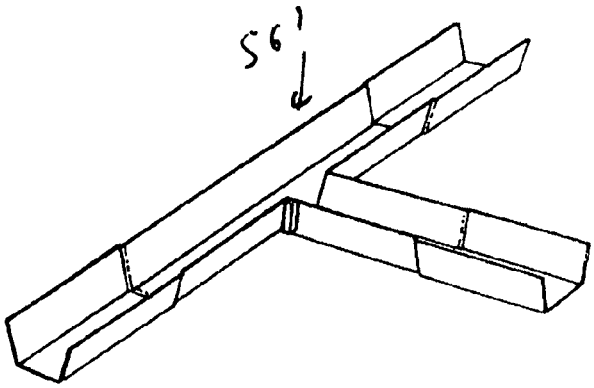
Fig. 10

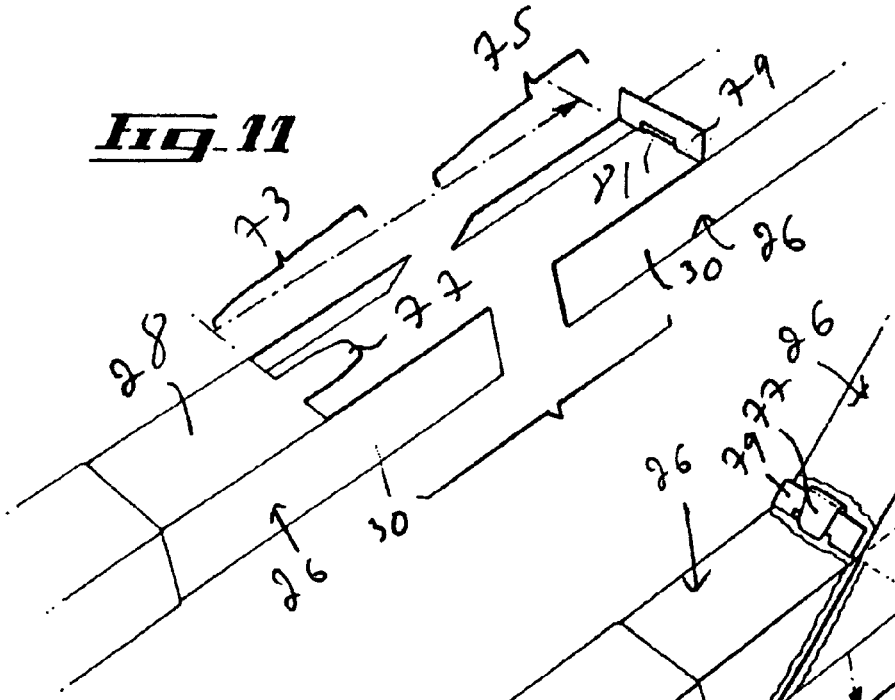
Fig. 11
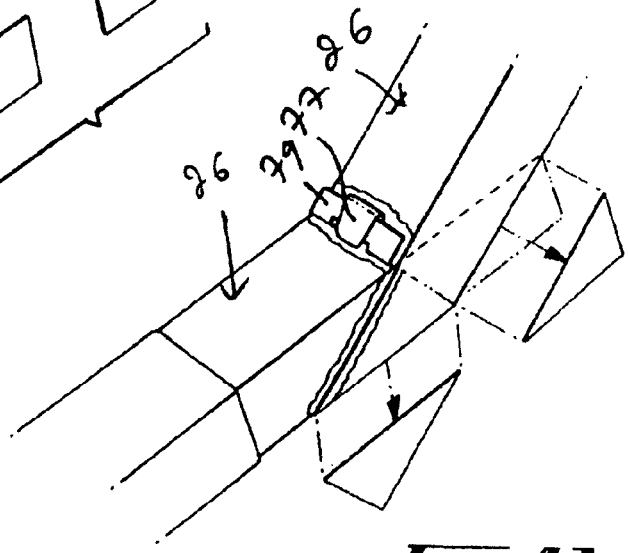
Fig. 12
Fig. 13
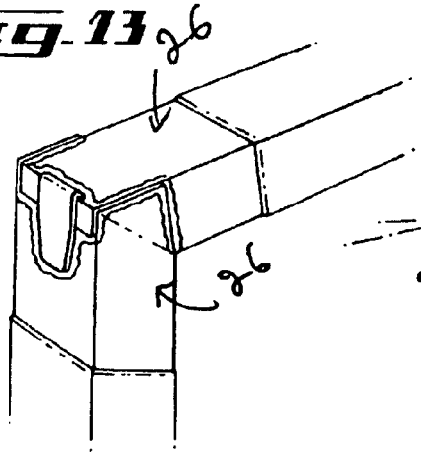
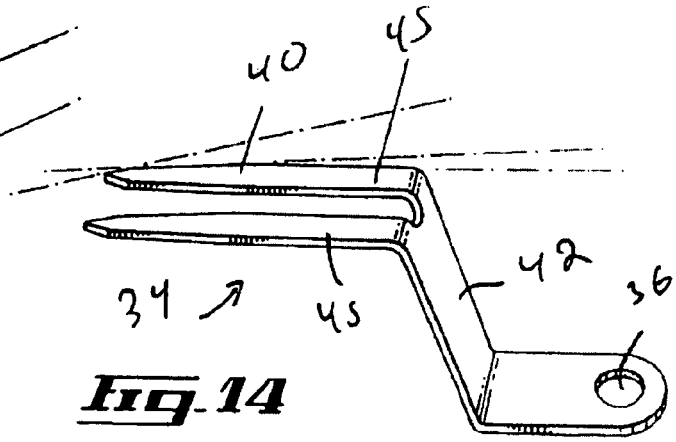
Fig. 14

Fig. 15
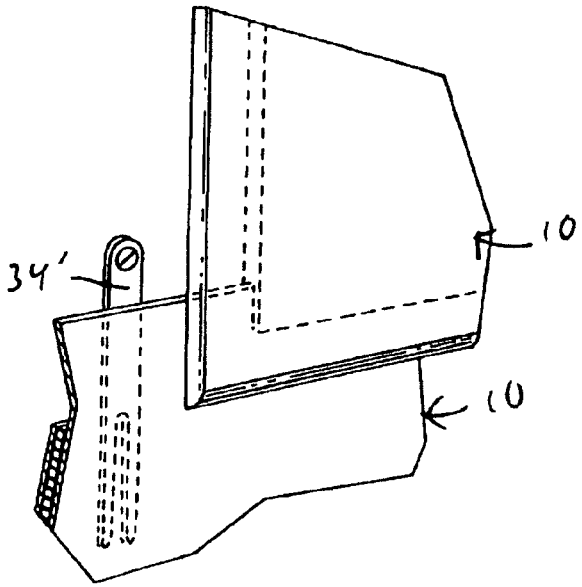
Fig. 16
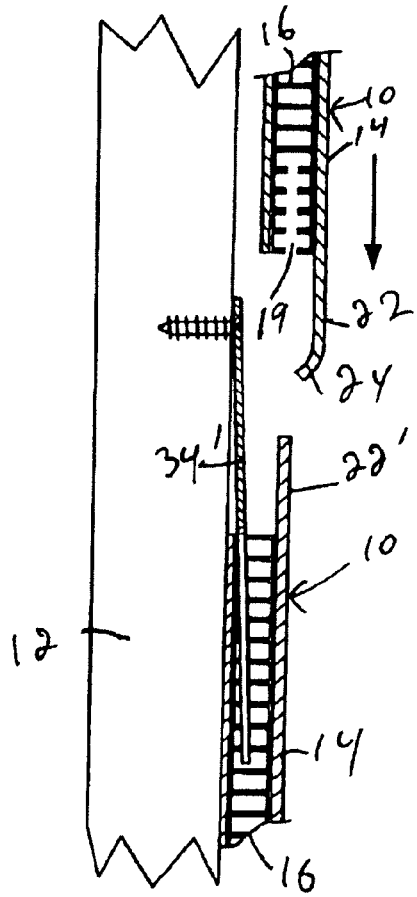
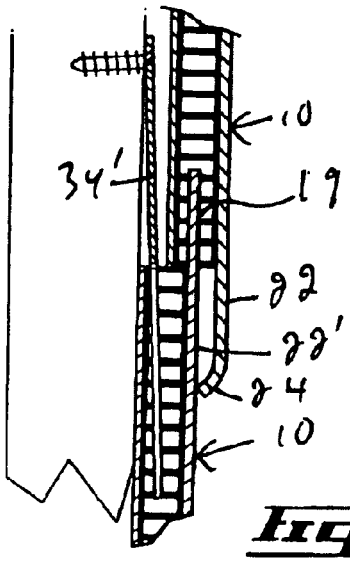
Fig. 17

CLADDING METHOD AND SYSTEM FOR BUILDINGS

This application claims priority from UK patent number 0606824.1 dated Apr. 5, 2006.

FIELD OF THE INVENTION

The present invention relates to the general field of architectural and building construction and is particularly concerned with a cladding method and system for buildings.

BACKGROUND OF THE INVENTION

Despite the fact that the general construction of most building structures has remained substantially constant throughout the years, the exterior appearance giving to buildings structures is a matter of constant architectural upgrading and variation as different systems and looks become popular. One such popular exterior surface appearance to building structures, and especially, but not exclusively, in commercial or taller building structures, relates to the utilization of cladding material panels to cover the exterior surface of the building structure. Such cladding material is also sometimes used to cover interior surfaces of the building structure.

In particular, composite panels including a metallic surface have proven to be particularly useful and popular for architectural and display applications such as wall coverings and roofings. One particular, although by no means exclusive example of such cladding panel is the so-called Omega-Lite (a trade mark) panel manufactured by Laminator Inc. Such panels include a prefinished aluminum sheet bound to a polymer core having a triangular truss design. However, the core has any other suitable design in alternative cladding panels. Such aluminum panels typically provide durable, eye-catching fascias and may be used, by way of example, for corporate identity projects. The prior art has shown various examples of complex fastening and support systems used to connect exterior panels such as aluminum fascia panels together to form the exterior of commercial buildings. Indeed, because of the extensive utilization of exterior panels, a variety of different types of connecting brackets have been developed over the years to serve as means for fastening these panels together while also forming a sturdy support structure. However, most prior art fastening systems suffer from inherent problems or shortcomings.

One such problem is that most fastening systems presently known in the art tend to be overly complex in structure and are composed of many relatively small pieces susceptible to easy loss or damage during installation. Consequently, installation of the panels is not only tedious and time-consuming but also relatively expensive.

Another major drawback associated with prior art panel fastening systems relate to their lack of aesthetics. Indeed, caulking or other material positioned between panels deters the overall aesthetical appearance of the surface formed by the panels. This may prove to be a particularly strong drawback to the wider acceptance of cladding surfacing of buildings.

Still, furthermore, another drawback associated with most prior art panel attachment systems relates to the fact that prior art systems and methods require that their attachment components be premanufactured and, hence, lack versatility at the construction site. Furthermore, when most prior art systems are employed to secure panels to the exterior of a building, the panels must be installed in a specified progressive sequence along each face of the building. Hence, if a panel in the middle of a wall is incorrectly installed or subsequently damaged, all the panels from the edge of the wall back to the damaged panel must be removed in reverse order in order to replace the single damaged panel. This is not only a waste of construction time but it inherently exposes the undamaged panels to damage themselves by having to remove them once set.

A common type of cladding system utilized in the present art involves the utilization of a plurality of pegs or clips that extend typically into the upper or lower edges of the material panel. These clips or pins typically include an L- or T-shaped construction which extends into a corresponding notch defined in a corresponding edge of the cladding material panel. Such pin or clip-type cladding systems have a substantial number of attendant drawbacks associated with their use. One such drawback relates to the fact that surface contours vary from place to place on the exterior surface of the building structure. However, as is often the case when covering existing building structures, the precise positioning and orientation of adjacently positioned cladding material panels may need to be varied. Conventional pin or clip designs, if they are structured so as to accommodate securement of adjacent panels, typically do not provide any adjustability, such as for spacing between the panels and/or for spacing relative to a wall structure of the building.

Also, thermal expansion of the cladding components once installed creates may create stresses in the cladding structure that may result in a shortened life cycle. This disadvantage is aggravated by the fact that a conventional pin-type cladding material type fastener concentrates the load exerted thereby at relatively restricted locations along the surface of the panel and indeed, concentrate a break point or tension point of the material panel into the notch defined therein.

Accordingly, there exists a need for an improved cladding method and system for buildings. It is a general object of the present invention to provide such a cladding method system.

SUMMARY OF THE INVENTION

In a first broad aspect, the invention provides a cladding system for cladding a supporting structure, the cladding system comprising:

a first cladding panel, the first cladding panel including a first panel core and a first panel exterior sheet extending from the first panel core, the first panel core being substantially planar, the first panel core and the first panel exterior sheet being substantially parallel to each other, the first panel exterior sheet defining a first panel flange extending substantially laterally from the first panel core;

a second cladding panel, the second cladding panel including a second panel core and a second panel exterior sheet extending from the second panel core, the second panel core being substantially planar, the second panel core and the second panel exterior sheet being substantially parallel to each other, the second panel exterior sheet defining a second panel flange extending substantially laterally from the second panel core;

the first and second cladding panels being attachable to the supporting structure in a substantially coplanar and side-by-side relationship relatively to each other such that the first and second panel cores are positioned respectively between the first and second panel exterior sheets and the supporting structure;

the first and second panel flanges are substantially spaced apart from each other and define a sheet gap extending therebetween, the sheet gap having a sheet gap width; and the first and second cladding panels define a core gap extending between the first and second panel cores;

the cladding system also comprising a cladding moulding insertable between the first and second cladding panels, the cladding moulding defining a moulding base and two moulding legs each extending from the moulding base substantially opposed to each other, the moulding base and the two moulding legs each having a substantially elongated configuration, the two moulding legs being angled relatively to the moulding base, each of the moulding legs defining a respective leg edge substantially opposed to the moulding base;

the cladding moulding being substantially resiliently deformable between an undeformed configuration and a deformed configuration, the moulding legs being spaced apart from each other by a smaller distance in the deformed configuration than in the undeformed configuration, the moulding legs substantially diverging from each other in a direction leading away from the moulding base in the undeformed configuration, wherein in the deformed configuration, the leg edges are spaced apart by a distance smaller than the sheet gap width and the cladding moulding is slidable through the sheet gap; and in the undeformed configuration, the cladding moulding is positionable such that the leg edges are located into the core gap with the leg edges spaced apart from each other by a distance larger than the sheet gap width;

whereby the substantially resilient deformation of the cladding moulding allows for snapping the cladding moulding in place between the first and second cladding panels after the first and second cladding panels have been attached to the supporting structure by pushing the cladding moulding through the sheet gap from the moulding base towards the leg edges, thereby causing the cladding molding to resiliently deform from the undeformed configuration towards the deformed configuration, the cladding moulding snapping back to the undeformed configuration once the leg edges are positioned into the core gap; and the removal the cladding moulding from the supporting structure while leaving the cladding panels in place by deforming the cladding moulding into the deformed configuration and sliding the cladding moulding through the sheet gap in a direction leading from the leg edges towards the moulding base.

In another broad aspect, the invention provides a wall including the cladding system and a supporting structure.

In yet another broad aspect, the invention provides a method for mounting a cladding structure to a supporting structure, the cladding structure including a first cladding panel, a second cladding panel and a cladding moulding, the first cladding panel including a first panel core and a first panel exterior sheet extending from the first panel core, the first panel exterior sheet defining a first panel flange extending substantially laterally from the first panel core; the second cladding panel including a second panel core and a second panel exterior sheet extending from the second panel core, the second panel exterior sheet defining a second panel flange extending substantially laterally from the second panel core; the cladding moulding defining a moulding base and two moulding legs each extending from the moulding base substantially opposed to each other, the moulding base and the two moulding legs each having a substantially elongated configuration, the two moulding legs being angled relatively to the moulding base, each of the moulding legs defining a respective leg edge substantially opposed to the moulding base, the cladding moulding being substantially resiliently deformable between an undeformed configuration and a deformed configuration, wherein in the deformed configuration, the leg edges are spaced apart by a smaller distance than in the undeformed configuration, the method comprising:

attaching the first and second cladding panels to the supporting surface in a substantially coplanar and side-by-side relationship relatively to each other such that the first and second panel cores are positioned respectively between the first and second panel exterior sheets and the supporting structure and the first and second panel flanges are substantially spaced apart from each other, the first and second panel flanges defining a sheet gap extending therebetween, the sheet gap having a sheet gap width, the first and second panel cores defining a core gap extending therebetween, the sheet gap width being smaller than a distance between the leg edges in the undeformed configuration; and snapping the cladding moulding in place between the first and second cladding panels after the first and second cladding panels have been attached to the supporting structure by pushing the cladding moulding through the sheet gap from the moulding base towards the leg edges, thereby causing the cladding moulding to resiliently deform from the undeformed configuration towards the deformed configuration, the cladding moulding snapping back to the undeformed configuration once the leg edges have cleared the sheet gap and are positioned into the core gap.

Advantages of the present invention include that the proposed cladding method and system is adapted to provide a simple and efficient solution to the problem of mounting cladding material to the exterior surface of buildings. The proposed method and system allows for fastening of cladding panels together and/or to the supporting structure, for example the exterior surface of a building, while also forming a sturdy structure.

The proposed method and system allows for mounting of cladding panels to the exterior surface of a building while maintaining or even improving on the overall aesthetical appearance of the overall cladding assembly including its mounting components.

The proposed method and system allows for the formation of relatively efficient seams and joints between adjacent panels. Also, in some embodiments of the invention, the joints formed between the cladding panels and the cladding mouldings has a built-in capacity of accommodating thermal expansion and retraction while minimizing stresses in these components.

Furthermore, the proposed method and system simplifies the placement of panel edges and provides flexibility in the installation procedure.

Furthermore, the proposed method and system allows for mounting of cladding panels to the exterior surface of buildings through a set of quick and ergonomic steps without requiring special tooling or excessive manual dexterity.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings, in which:

FIG. 7, in a perspective view, illustrates two cladding moulding in accordance with an embodiment of the present invention, the two cladding mouldings being attached to and angled relatively to each other;

FIG. 8, in a side elevation view, illustrates two cladding mouldings in accordance with an embodiment of the present invention, the two cladding mouldings being attached to and angled at another angle relatively to each other;

FIG. 9, in a perspective view, illustrates the two cladding mouldings shown in FIG. 8;

FIG. 10, in a perspective view, illustrates a substantially T-shaped cladding moulding in accordance with an embodiment of the present invention, the cladding moulding being shown assembled;

FIG. 11, in a perspective view, illustrates an assembly of the two cladding mouldings shown in FIG. 7, the two cladding moulding mouldings being shown before the assembly thereof;

FIG. 12, in perspective view, illustrates the assembly of the two cladding mouldings shown in FIGS. 7 and 11, the two cladding moulding mouldings being shown attached to each other at a first angle;

FIG. 13, in perspective view, illustrates the assembly of the two cladding mouldings shown in FIGS. 8 and 11, the two cladding moulding mouldings being shown attached to each other at a second angle;

FIG. 14, in a perspective view, illustrates an mounting clip bracket part of a cladding method and system in accordance with an embodiment of the present invention;

FIG. 15, in a partial perspective view with parts taken out, illustrate a cladding system in accordance with another embodiment of the present invention;

FIG. 16, in a partial side cross-sectional view, illustrates two cladding panels of the cladding system shown in FIG. 15, the cladding panels being shown prior to assembly; and FIG. 17, in a partial side cross-sectional view, illustrates two cladding panels of the cladding system shown in FIGS. 15 and 16, the cladding panels being shown after assembly.

DETAILED DESCRIPTION

Figure 1:
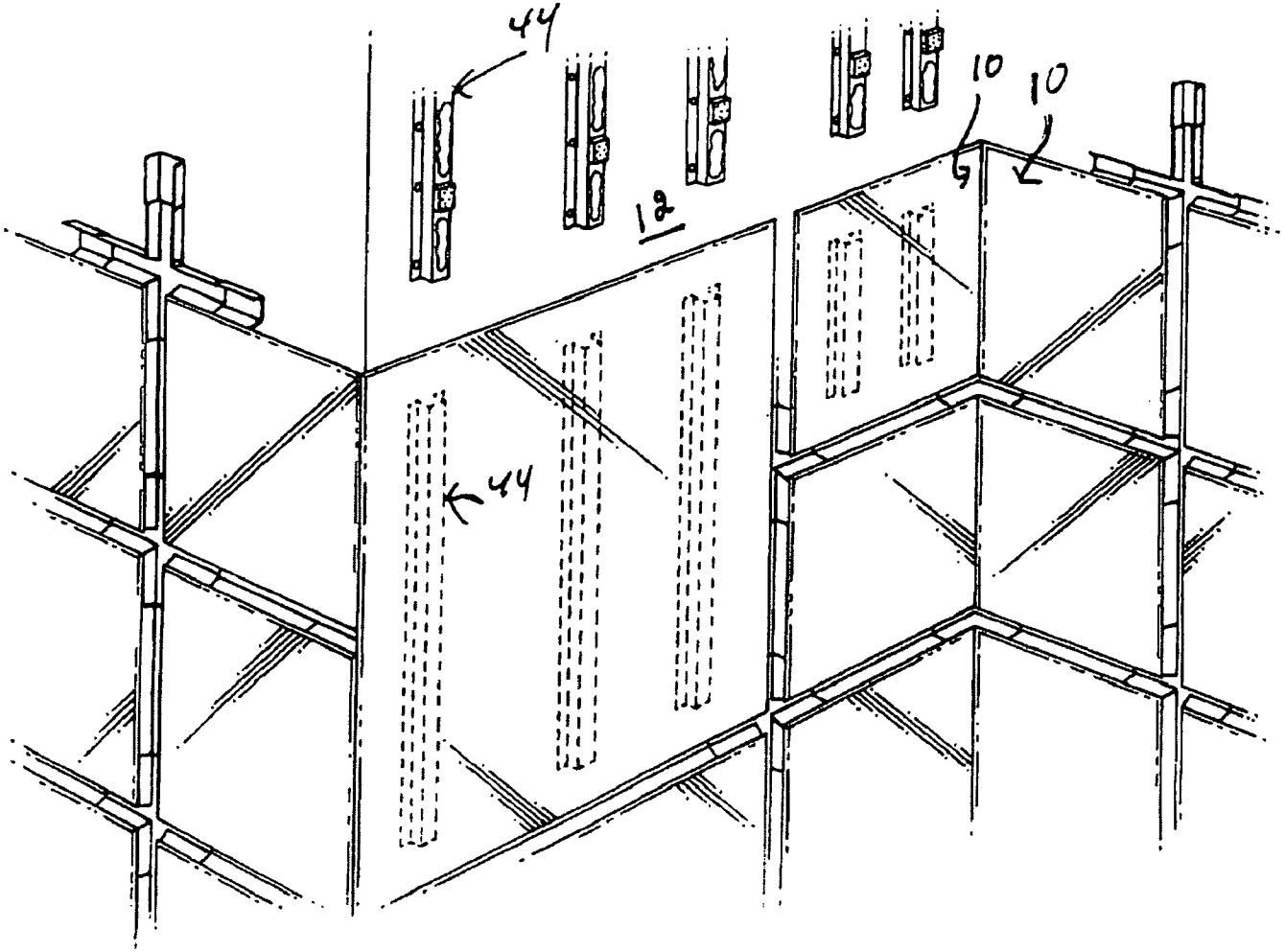
FIG. 1, in a partial perspective view, illustrates two corner wall sections part of the exterior wall of a building, the corner wall sections being shown with some cladding panels attached thereto and about to receive additional cladding panels.

Referring to FIG. 1, there is shown a plurality of cladding panels 10 attached to a supporting structure 12 such as the exterior wall of a building or the like. The cladding panels 10 are attached to the supporting structure 12 using a cladding method and system in accordance with an embodiment of the present invention.

Figure 2:
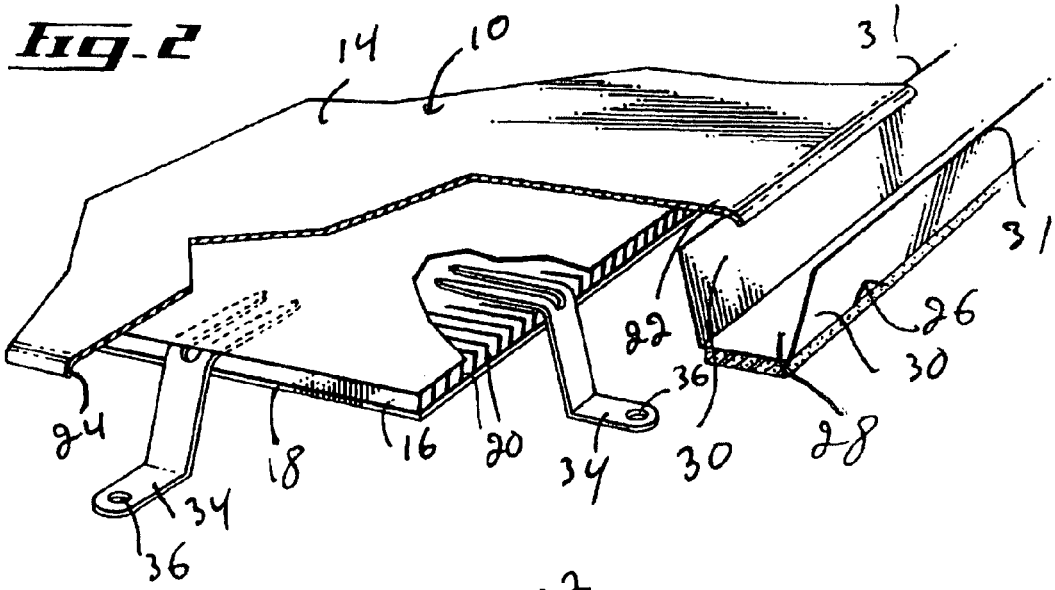
FIG. 2, in a partial perspective view with sections taken out, illustrates the corner wall sections shown in FIG. 1.

The cladding panels 10 could be of any suitable construction. For example, as illustrated more specifically in FIG. 2, each cladding panel 10 includes a pre-finished panel exterior sheet 14 made out of a suitable material such as aluminum or the like. Each panel 10 also includes a panel core 16 secured to the inner surface of the corresponding panel exterior sheet 14 by a suitable fastening means such as an adhesive material or the like.

The panel core 16 may take any suitable form. Typically, the panel core 16 is designed so as to have a substantially truss-like cross-sectional design defining a core inner surface 18 and a set of spacing ribs 20. The panel core 16 may be made out of any suitable material such as a polymer or the like. The configuration of the truss design may take any suitable form such as a triangular configuration without departing from the scope of the present invention. Also, in alternative embodiments of the invention, the panel core may have any other suitable configuration, such as a honeycomb structure, for example.

Each panel 10 defines a panel flange 22 as the panel sheet 14 protrudes outwardly and exceeds the panel core 16. Typically, but not necessarily, each panel flange 22 is provided with an inwardly bent flange end segment 24. In other words, the flange end segment 24 is angled substantially towards the supporting structure 12 when the cladding panel 10 is attached to the supporting structure 12 and is also angled in a direction leading substantially laterally outwardly away from the panel core 16.

Typically, the panel exterior sheet 14 extends from the panel core 16 and the panel core 16 and the panel exterior sheet 14 are substantially planar and substantially parallel to each other. The panel flange 22 therefore extends substantially laterally from the panel core 16.

Figure 3:
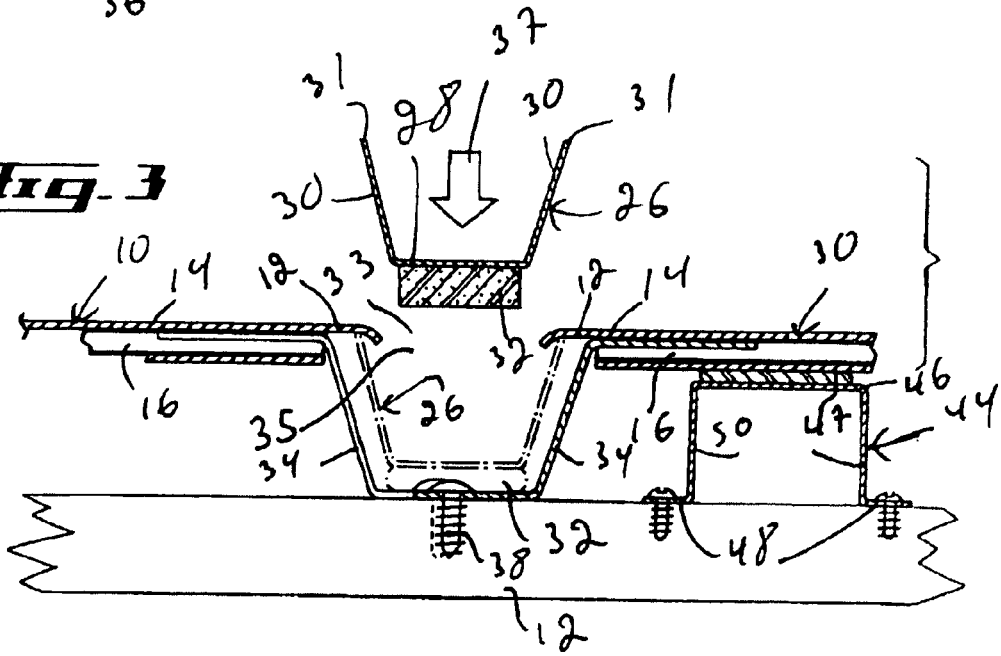
FIG. 3, in a partial side cross-sectional view with sections taken out, illustrates the corner wall sections shown in FIGS. 1 and 2.

As seen in FIG. 3, the cladding panels 10 are attached to the supporting structure 12 in a substantially coplanar and side-by-side relationship relatively to each other such that their panel cores 16 are positioned between their panel exterior sheets 14 and the supporting structure. Also, the panel flanges 22 of adjacent cladding panels 10 are substantially spaced apart from each other and define a sheet gap 33 extending therebetween, the sheet gap having a sheet gap width. Furthermore, a core gap 35 extends between adjacent panel cores 16.

The cladding system also includes a cladding moulding 26 adapted to be inserted and mounted between adjacent cladding panels 10. Each cladding moulding 26 typically has substantially flattened V-shaped cross-sectional configuration defining a substantially flat moulding base 28 and two moulding legs 30 each extending from the moulding base 28 substantially opposed to each other. The moulding base 28 and the two moulding legs 30 each have a substantially elongated configuration. The two moulding legs 30 are angled relatively to the moulding base 28 and each define a respective leg edge 31 substantially opposed to the moulding base 28. The moulding legs 30 extend from the moulding base 28 so as to diverge away from each other in a direction leading away from the moulding base 28.

At least a portion of the cladding moulding 26 is made out of a substantially resiliently deformable material so as to allow the moulding legs 30 to bend resiliently towards each other and to resiliently spring back towards their original diverging configuration.

More specifically, the cladding mouldings 26 are substantially resiliently deformable between an undeformed configuration and a deformed configuration, the moulding legs 30 being spaced apart from each other by a smaller distance in the deformed configuration than in the undeformed configuration. In the deformed configuration, the leg edges 31 are spaced apart by a distance smaller than the sheet gap width and the cladding moulding 26 is slidable through the sheet gap 33, as indicated by the arrow 37 of FIG. 3. In the undeformed configuration, the cladding moulding 26 is positionable, as seen in phantom lines, such that the leg edges 31 are located into the core gap 35 with the leg edges 31 spaced apart from each other by a distance larger than the sheet gap width.

Therefore, the substantially resilient deformation of the cladding moulding 26 allows for snapping the cladding moulding 26 in place between adjacent cladding panels 10 after the cladding panels 10 have been attached to the supporting structure 12 by pushing the cladding moulding 26 through the sheet gap 33 from the moulding base 28 towards the leg edges 31. This causes the cladding moulding 26 to resiliently deform from the undeformed configuration towards the deformed configuration, the cladding moulding 26 snapping back to the undeformed configuration once the leg edges 31 are positioned into the core gap 35. Also, removal of the cladding moulding 26 from the supporting structure 12 while leaving the cladding panels 10 in place is made possible by deforming the cladding moulding 26 into the deformed configuration and sliding the cladding moulding 26 through the sheet gap 33 in a direction leading from the leg edges 31 towards the moulding base 28.

Also, each moulding 26 is typically provided with a corresponding moulding cushioning component 32 attached to the undersurface of the moulding base 28, and therefore extending from the moulding base 28 substantially opposed to the moulding legs 30. The moulding cushioning component 32 is typically made out of a substantially resiliently deformable material.

The cladding system typically still further includes at least one and typically a plurality of mounting clips 34. Each mounting clip 34 typically includes a clip mounting segment mountable to the supporting structure, the clip mounting segment including a clip-to-wall mounting means such as an eyelid 36 adapted to receive corresponding fastening components such as a screw 38 or the like. As better seen in FIG. 14, each mounting clip 34 further includes a clip panel attachment segment 40. The clip panel attachment segment 40 is mountable to the cladding panels 10, for example by being configured and sized so as to be insertable within the panel core 16. Each mounting clip 34 further includes a clip spacing segment 42 extending between the eyelids 36 and the clip panel attachment segment 40 in a substantially angled relationship relative thereto. This configuration allows for spacing the cladding panels 10 from the supporting structure 10 while ensuring that the mounting clip 34 has a relatively large contact area with the cladding panel 10, thereby reducing stress concentrations in the cladding system.

In some embodiments of the invention, the clip panel attachment segment 40 defines a fork insertable into the panel cores 16. The fork 45 includes fork segments 45 that are substantially parallel to each other and which are tapered in a direction leading away from the clip spacing segment 42, thereby facilitating their insertion into the panel cores 16. This structure also reduces stresses exerted in the cladding system due to differential in thermal expansion coefficients between the supporting structure 12 and the cladding panels 10 as the fork 45 is typically movable longitudinally relatively to the cladding panel 10.

The cladding system typically still further includes furring strips 44 illustrated, by way of example, in FIG. 3. The furring strips 44 may take any suitable form and are attachable to the supporting structure 12 so as to be positioned between and abutting against the supporting structure 12 and the cladding panels 10. In the embodiment of the invention shown throughout the Figures, each furring strips 44 includes a furring contacting segment 46 for contacting a corresponding panel 10 and providing a substantially flat and durable attachment surface therefor. Each furring strip 44 also includes furring attachment flanges 48 for attachment to the wall surface 12 and furring spacing segments 50 extending between the furring contacting segment 46 and the furring attachment flanges 48.

The furring contacting segment 46 defines a panel contacting surface 47 abutting against the cladding panels 10, the panel contacting surface 47 being typically provided with an adhesive material for adhering to the cladding panels 10. Typically, a furring strip cushion 54 defines at least in part the panel contacting surface 47 to optimize the adhesive contact between the furring strip 44 and the panel 10.

Figure 4:
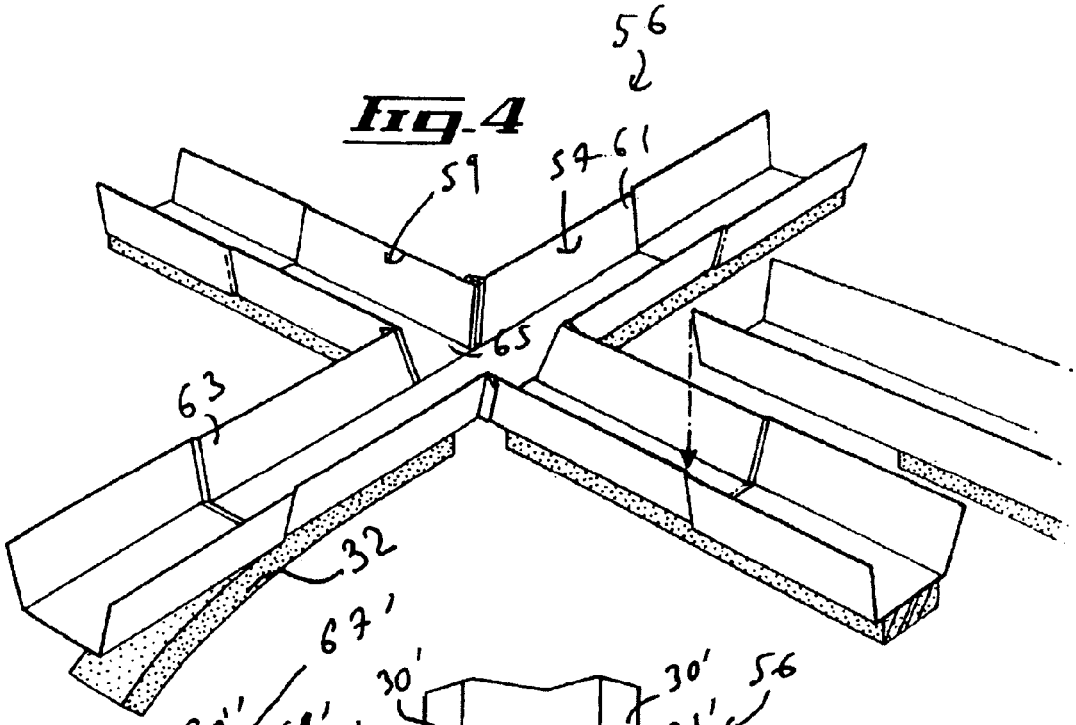
FIG. 4, in a perspective view, illustrates a corner moulding in accordance with an embodiment of the present invention, the corner moulding being shown assembled.
Figure 5:
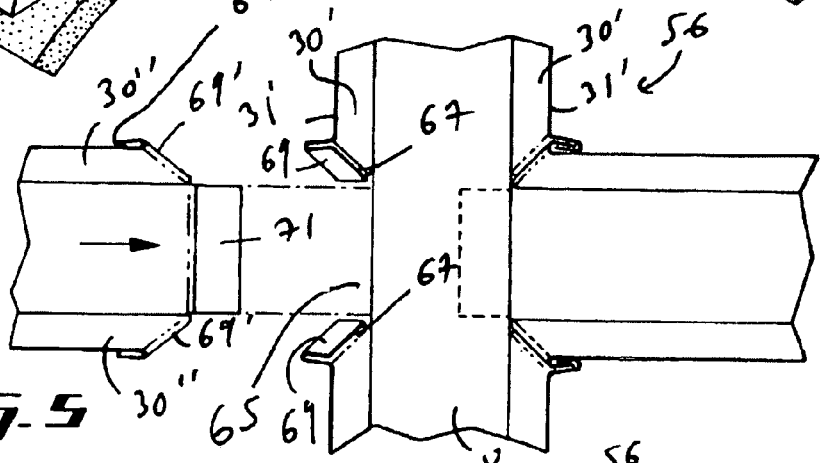
FIG. 5, in a top plan view, illustrates the corner moulding shown in FIG. 4, the corner moulding being shown partially assembled.
Figure 6:
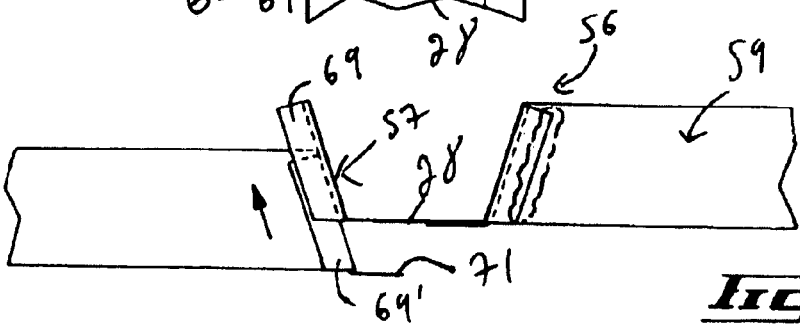
FIG. 6, in a partial side elevation view, illustrates the assembly of the corner moulding shown in FIGS. 4 and 5.

The cladding system 10 typically still further includes corner mouldings 56 such as such shown in FIGS. 4 through 6 having various configurations and sizes and adapted to be mounted to the supporting surface 12 at the intersection between corner sections of adjacent cladding panels 10. For example, the corner mouldings 56 may be assembled using a corner base moulding 57 and two corner extensions mouldings 59. The corner base moulding 57 defines a moulding first end section 61 and a substantially longitudinally opposed moulding second end section 63.

At least one of the moulding legs 30' of the corner base moulding defines a leg aperture 65, better shown in FIG. 5, extending into the moulding legs 30' from the leg edge 31' of the at least one of the moulding legs 30' towards the moulding base 28. The leg aperture 65 is located at a location intermediate the moulding first and second end sections 61 and 63.

The moulding legs 30' define leg joining folds 69 extending substantially perpendicularly to the moulding legs 30' on each side of the leg apertures 65 and defining a junction aperture 67 extending towards the moulding base 28. Similarly, the corner extensions mouldings 59 have moulding legs 30" that are folded onto themselves at one end thereof, and therefore also define leg joining folds 69' that define a junction aperture 67'. Folding the moulding legs 30" leaves a prominent portion of the moulding base 28 forming a tongue 71.

As seen in FIGS. 4 to 6, the leg joining folds 69 and 69' are engageable to each other with the tongue 71 positioned below the moulding base 28 of the corner base moulding 57, thereby attaching the corner base moulding 57 and the corner extension molding 59 to each other, thereby allowing for the easy assembly of the corner moulding 56 at a construction site. However, in alternative embodiments of the invention, the corner mouldings 56 are assembled in any other suitable manner. In some embodiments, glue or any other suitable substance is used to secure the leg joining folds 69 and 69' to each other. A similar structure is usable to form a T-shaped moulding 56', as seen in FIG. 10 and, by forming folds at the end of two cladding mouldings 26, L-shaped mouldings 56", as seen in FIG. 8.

As seen in FIGS. 7 and 9, in some embodiments of the invention, two cladding mouldings 26 may be joined to each other in an end-to-end relationship relatively to each other, and if required, angled such that their longitudinal axes are angled relatively to each other.

Referring to FIGS. 11 to 13, a method of assembling two such mouldings 26 in this manner is briefly described. Each cladding mouldings 26 defines a respective moulding first end section 73 and a substantially longitudinally opposed respective moulding second end section 75, the moulding first end section of one 73 cladding moulding 26 being attachable to the moulding second end section 75 of another cladding mouldings 26.

To that effect, the moulding first end section 73 has cladding legs 30 that extend longitudinally prominently relatively to the moulding base 28. The moulding base 28 defines a longitudinally extending moulding tongue 77. The moulding second end section 75 has cladding legs 30 that extend longitudinally prominently relatively to the moulding base 28, a base flange 79 extending substantially perpendicularly from the moulding base 28 in a direction substantially opposed to the cladding legs 30. The base flange 79 defines an aperture 81 at its junction with the moulding base 28. The base flange 79 is located, configured and sized such that when the two cladding mouldings 26 are positioned end-to-end, the moulding tongue 77 may be inserted through the aperture 81 and folded back onto the base flange 79 to attach the two cladding mouldings 26 to each other, as seen in FIG. 12.

If required, the two cladding mouldings 26 are then angled relatively to each other and portions of the moulding legs 30 that extend prominently relatively to the assembled cladding mouldings 26 may be removed. In some embodiments of the invention, as seen in FIGS. 12 and 13, a bonding material, such as a glue or the like, is used to further secure the cladding mouldings 26 to each other.

In use, the cladding panels 10 may either be pre-fabricated with their panel flanges 22 or purchased with their respective panel cores 16 extending all the way to the peripheral edge of the panel exterior sheets 14. In such instances, a portion of the panel core 16 is removed to form the panel flanges 22 using a suitable tool. The flange end section 24 is then formed by curving the latter inwardly in any suitable manner, for example using a tool such as a curving tool including tool rollers adapted to be rolled on the upper surface of the panel exterior sheet 14. The tool rollers are rollably mounted on a tool plate defining a tool edge for contacting the panel end section 24 and bending the latter downwardly as the tool rollers are rolled on the upper surface of the panel exterior sheet 14.

Furring strips 44 are attached to the supporting surface 12 in any suitable manner. The cladding panels 10 are then mounted over the furring strips 44. The mounting clips 34 are secured to the supporting surface 12 and to the panel core 16 of the cladding panels 10 for securing the cladding panels 10 while the adhesive bond between the furring strips 44 and the cladding panels 10 is formed.

As seen in FIG. 3, the cladding moulding 26 is then pushed between adjacent panels 10. The cladding moulding 26 is snapped in place between adjacent cladding panels 10 by pushing the cladding moulding through the sheet gap 33 from the moulding base 28 towards the leg edges 31, thereby causing the cladding molding to resiliently deform from the undeformed configuration towards the deformed configuration, the cladding moulding 26 snapping back to the undeformed configuration once the leg edges 31 have cleared the sheet gap 33 and are positioned into the core gap 35. The moulding cushioning component 32 typically resiliently biases the leg 31 against the inner surface of the panel exterior sheet 14.

FIGS. 15 to 17 illustrate an alternative embodiments of the invention wherein cladding panels 10 are mounted in substantially adjacent relationship, and typically in an abutment relationship, relatively to the supporting structure 12. To that effect, an alternative mounting clip 34' is substantially elongated and flat and positioned slightly angled relatively to the mounting structure 12 so as to attach a cladding panel 10 to the supporting structure 12. This cladding panel 10 has a panel flange 22' that is substantially planar and therefore does not define the angled panel end section 24. The other cladding panel 10 has a slit 19 formed in its panel core 16, the slit 19 extending in a direction opposite to the panel flange 22 thereof. To secure the two cladding panels 10 to each other, the panel flange 22 is inserted into the slit 19 such that the panel end section 24 of the cladding panel 10 in which the slit 19 is defined abuts against the top surface of the panel exterior sheet 14 of the other cladding panel 10. Therefore, the two panel exterior sheets 14 are in a substantially partially overlying relationship relatively to each other.

In some embodiments, caulking or any other suitable material is applied at the junction between the two cladding panel to further weather-proof the assembled cladding. By repeating these operations for all cladding panels 10, the alternative cladding structure is obtained. In some embodiments of the invention, each cladding panels includes panel flanges 22 of the first type and panel flanges 22' of the second type. In these embodiments, the cladding system when assembled forms a substantially snake skin-like structure with cladding panels 10 that partially overlap each other.

Although the present invention has been described hereinabove by way of preferred embodiments thereof, it can be modified, without departing from the spirit and nature of the subject invention as defined in the appended claims.

What is claimed is:

1. A cladding system for cladding a supporting structure, said cladding system comprising:

a first cladding panel, said first cladding panel including a first panel core and a first panel exterior sheet extending from said first panel core, said first panel core being substantially planar, said first panel core and said first panel exterior sheet being substantially parallel to each other, said first panel exterior sheet defining a first panel flange extending substantially laterally from said first panel core;

a second cladding panel, said second cladding panel including a second panel core and a second panel exterior sheet extending from said second panel core, said second panel core being substantially planar, said second panel core and said second panel exterior sheet being substantially parallel to each other, said second panel exterior sheet defining a second panel flange extending substantially laterally from said second panel core;

said first and second cladding panels attached to said supporting structure in a substantially coplanar and side-by-side relationship relatively to each other such that said first and second panel cores are positioned respectively between said first and second panel exterior sheets and said supporting structure;

said first and second panel flanges are substantially spaced apart from each other and define a sheet gap extending therebetween, said sheet gap having a sheet gap width; and said first and second cladding panels define a core gap extending between said first and second panel cores;

said cladding system also comprising a cladding moulding inserted between said first and second cladding panels, said cladding moulding defining a moulding base and two moulding legs each extending from said moulding base substantially opposed to each other, said moulding base and said two moulding legs each having a substantially elongated configuration, said two moulding legs being angled relatively to said moulding base, each of said moulding legs defining a respective leg edge substantially opposed to said moulding base, said cladding moulding including a moulding cushioning component extending from said moulding base substantially opposed to said moulding legs, said moulding cushioning component being substantially resiliently deformable;

said cladding moulding being substantially resiliently deformable between an undeformed configuration and a deformed configuration, said moulding legs being spaced apart from each other by a smaller distance in said deformed configuration than in said undeformed configuration, said moulding legs substantially diverging from each other in a direction leading away from said moulding base in said undeformed configuration, wherein in said deformed configuration, said leg edges are spaced apart by a distance smaller than said sheet gap width and said cladding moulding is slidable through said sheet gap; and in said undeformed configuration, said cladding moulding is positionable such that said leg edges are located into said core gap with said leg edges spaced apart from each other by a distance larger than said sheet gap width;

said cladding system further comprising a mounting clip, said mounting clip including a clip mounting segment mounted to said supporting structure, a clip panel attachment segment attachable to at least one of said first and second cladding panels and a clip spacing segment extending therebetween;

whereby said substantially resilient deformation of said cladding moulding allows for snapping said cladding moulding in place between said first and second cladding panels after said first and second cladding panels have been attached to said supporting structure by pushing said cladding moulding through said sheet gap from said moulding base towards said leg edges, thereby causing said cladding molding to resiliently deform from said undeformed configuration towards said deformed configuration, said cladding moulding snapping back to said undeformed configuration once said leg edges are positioned into said core gap; and the removal of said cladding moulding from said supporting structure while leaving said cladding panels in place by deforming said cladding moulding into said deformed configuration and sliding said cladding moulding through said sheet gap in a direction leading from said moulding base away from said leg edges.

2. A cladding system as defined in claim 1, wherein said clip mounting and panel attachment segments are substantially parallel to each other and said clip spacing segment is angled relatively to said clip mounting and panel attachment segments.

3. A cladding system as defined in claim 2, wherein said clip panel attachment segment defines a fork insertable into one said first and second panel cores.

4. A cladding system as defined in claim 2, further comprising a furring strip attached to said supporting structure so as to be positioned between and abutting against said supporting structure and said at least one of said first and second cladding panels.

5. A cladding system as defined in claim 4, wherein said furring strip defines a panel contacting surface abutting against said at least one of said first and second cladding panels, said panel contacting surface being provided with an adhesive material for adhering to said at least one of said first and second cladding panels.

6. A cladding system as defined in claim 5, further comprising a furring strip cushion, said furring strip cushion defining at least a portion of said panel contacting surface.

7. A cladding system as defined in claim 1, wherein said first panel flange defines a first flange end segment, said first flange end segment being angled substantially towards said supporting structure when said first cladding panel is attached to said supporting structure.

8. A cladding system as defined in claim 7, wherein said first panel flange is also angled in a direction leading substantially laterally outwardly away from said first panel core.

9. A cladding system as defined in claim 1, comprising at least two cladding mouldings, each of said at least two cladding mouldings defining a respective moulding first end section and a substantially longitudinally opposed respective moulding second end section, said moulding first end section of one of said at least two cladding mouldings being attached to said moulding second end section of another one of said at least two cladding mouldings.

10. A cladding system as defined in claim 1, wherein said cladding moulding defines a moulding first end section and a substantially longitudinally opposed moulding second end section, at least one of said moulding legs defining a leg aperture extending into said at least one of said moulding legs from said leg edge of said at least one of said moulding legs towards said moulding base, said leg aperture being located at a location intermediate said moulding first and second end sections.

* * * * *